US009177515B2

(12) United States Patent
Chen et al.

(10) Patent No.: US 9,177,515 B2
(45) Date of Patent: Nov. 3, 2015

(54) LIQUID CRYSTAL DISPLAY AND 3D IMAGING APPARATUS AND OPERATING METHODS THEREOF

(71) Applicant: InnoLux Corporation, Miao-Li County (TW)

(72) Inventors: Cheng-Yi Chen, Miao-Li County (TW); Li-Ming Huang, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 70 days.

(21) Appl. No.: 13/949,784

(22) Filed: Jul. 24, 2013

(65) Prior Publication Data

US 2014/0028736 A1 Jan. 30, 2014

(30) Foreign Application Priority Data

Jul. 27, 2012 (TW) ..... 101127129 A

(51) Int. Cl.
*G09G 3/34* (2006.01)
*G09G 3/36* (2006.01)
*G09G 3/00* (2006.01)

(52) U.S. Cl.
CPC ..... *G09G 3/3611* (2013.01); *G09G 3/003* (2013.01); *G09G 2310/0202* (2013.01)

(58) Field of Classification Search
None
See application file for complete search history.

(56) References Cited

U.S. PATENT DOCUMENTS

2005/0083319 A1 4/2005 Kodate et al.
2011/0018859 A1* 1/2011 Ito ..... 345/213
2013/0002653 A1* 1/2013 Lee et al. ..... 345/419

FOREIGN PATENT DOCUMENTS

CN 1598917 A 3/2005
CN 1773598 A 5/2006
CN 1292397 C 12/2006
CN 101414089 A 4/2009
CN 101727802 A 6/2010
CN 101882430 A 11/2010
CN 102547361 A 7/2012
TW 201225050 A1 6/2012

OTHER PUBLICATIONS

Office Action of corresponding Taiwanese patent application No. 101127129 issued on Aug. 27, 2014.
Office Action issued on Apr. 3, 2015 of corresponding Chinese patent application No. 201210264035.7 (7 pgs.).

* cited by examiner

*Primary Examiner* — Joseph Haley
(74) *Attorney, Agent, or Firm* — Muncy, Geissler, Olds & Lowe, P.C.

(57) ABSTRACT

Liquid Crystal Display (LCD), 3D imaging apparatus and operating methods thereof are disclosed. The operating method for the disclosed LCD includes the steps of: driving a pixel array of the LCD to display a frame of data by a first frame scan and a second frame scan; and, controlling a backlight module of the LCD in accordance with the first frame scan and the second frame scan. In the first frame scan, the scan lines of pixel array are driven in groups, wherein, in each group, all rows corresponding thereto are driven by identical data. The rows which have not been driven by correct data in the first frame scan are driven again and corrected in the second frame scan.

13 Claims, 6 Drawing Sheets

LIQUID CRYSTAL DISPLAY AND 3D IMAGING APPARATUS AND OPERATING METHODS THEREOF

CROSS REFERENCE TO RELATED APPLICATIONS

This Application claims priority of Taiwan Patent Application No. 101127129, filed on Jul. 27, 2012, the entirety of which is incorporated by reference herein.

BACKGROUND OF THE INVENTION

1. Field of the Invention

The present invention relates to a Liquid Crystal Display (LCD), a 3D imaging apparatus with the LCD, and operating methods for the LCD and the 3D imaging apparatus.

2. Description of the Related Art

A frame rate of an LCD is generally constrained by the reaction speed of liquid crystal (LC) materials. It is tricky to improve the frame rate without being constrained by the reaction speed of the LC materials.

Further, for a 3D imaging apparatus having an LCD and implemented according to active shutter 3D technology, the quality of 3D images also depends on the reaction speed of the LC materials of the LCD.

An active shutter 3D technology includes displaying left eye and right eye images alternately on a screen, to accordingly enable the left eye and right eye spectacle lens of a pair of 3D shutter glasses, for a viewer to perceive 3D images. Once the screen is implemented by an LDC, the switching of the spectacle lens is constrained by the reaction speed of the LC materials as well as the frame rate. The display of each image (left eye image or right eye image) may be too long to provide an excellent 3D experience. More consideration should be given in shutter 3D technology for the reaction speed of LC materials.

BRIEF SUMMARY OF THE INVENTION

A liquid crystal display (LCD), a 3D imaging apparatus using the LCD, and operating methods for the LCD and the 3D imaging apparatus are disclosed, to provide an excellent visual experience without being affected by the reaction speed of liquid crystal (LC) materials.

An LCD in accordance with an exemplary embodiment of the invention comprises a pixel array, a backlight module and a driver module. The driver module drives the pixel array to display a frame of data by a first frame scan and a second frame scan. Further, the driver module controls the backlight module in accordance with the first frame scan and second frame scan. The pixel array includes rows of pixels, and the pixels are arranged at intersections of the scan lines and the data lines. In the first frame scan, the driver module drives the scan lines of the pixel array group by group. The rows scanned by the scan lines of the same group are driven by identical data. In the second frame scan, the rows which have been pre-charged in the first frame scan but not driven by the correct data are scanned again by the driver module for correction.

A 3D imaging apparatus in accordance with an exemplary embodiment of the invention comprises the disclosed LCD and a pair of 3D shutter glasses. The driver module of the LCD further controls the pair of 3D shutter glasses in accordance with the first frame scan.

An LCD operating method in accordance with an exemplary embodiment of the invention comprises the following steps: driving a pixel array of an LCD to display a frame of data by a first frame scan and a second frame scan; and, controlling a backlight module of the LCD in accordance with the first frame scan and the second frame scan. The pixel array includes rows of pixels, and the pixels are arranged at intersections of the scan lines and the data lines. In the first frame scan, the scan lines of the pixel array are driven group by group. The rows scanned by the scan lines of the same group are driven by identical data. In the second frame scan, the rows which have been pre-charged in the first frame scan but not driven by the correct data are scanned again for correction.

An operating method for a 3D imaging apparatus in accordance with an exemplary embodiment of the invention comprises the following steps: operating an LCD of the 3D imaging apparatus by the aforementioned LCD operating method; and, controlling a pair of 3D shutter glasses of the 3D imaging apparatus in accordance with the aforementioned first frame scan.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description shows several exemplary embodiments carrying out the invention. This description is made for the purpose of illustrating the general principles of the invention and should not be taken in a limiting sense. The scope of the invention is best determined by reference to the appended claims.

Figure 1:
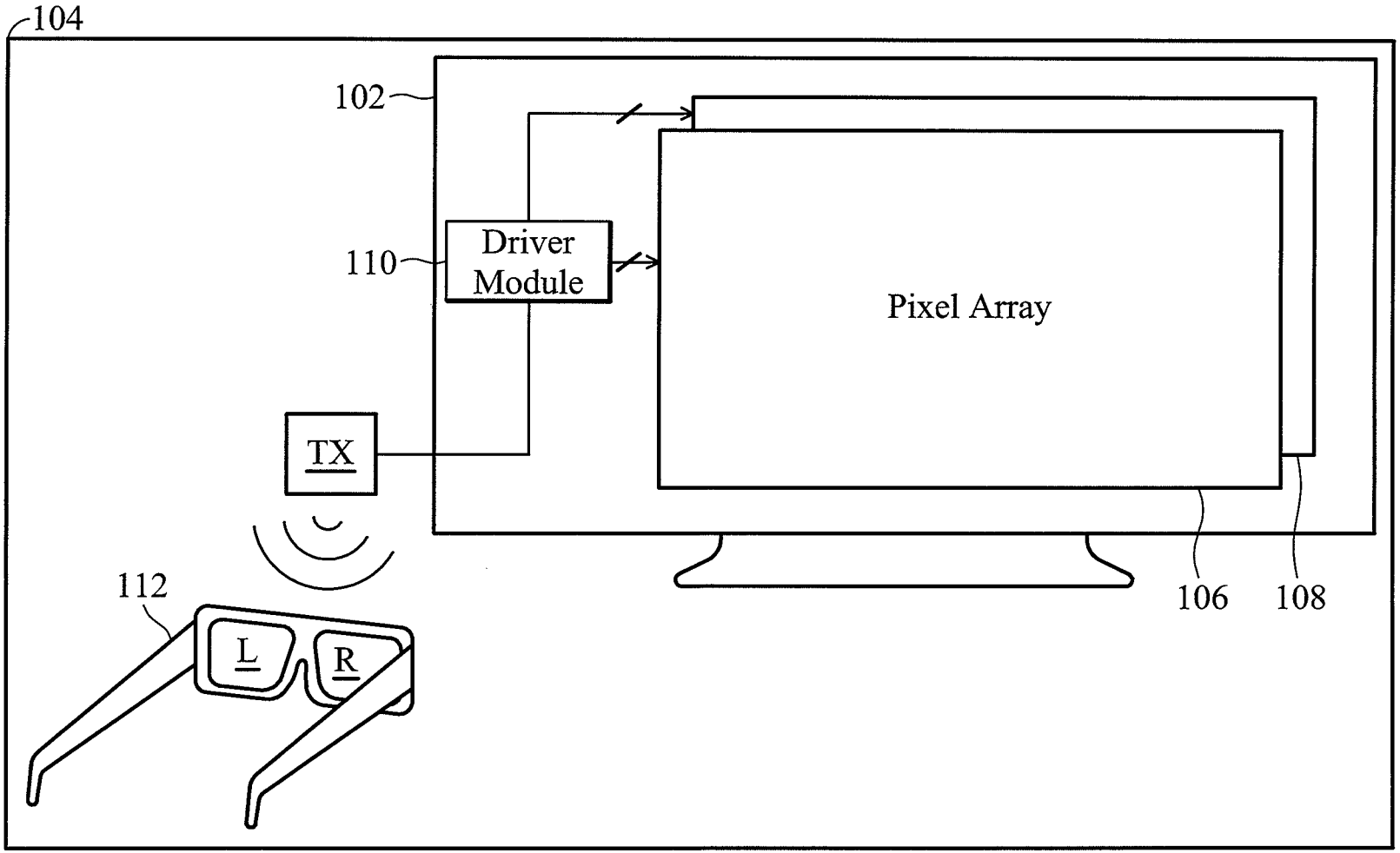
FIG. 1 depicts an LCD 102 and a 3D imaging apparatus 104 including the LCD 102 in accordance with exemplary embodiments of the invention.

FIG. 1 depicts an LCD 102 and a 3D imaging apparatus 104 including the LCD 102 in accordance with exemplary embodiments of the invention.

The LCD 102 comprises a pixel array 106, a backlight module 108 and a driver module 110. The driver module 110 controls the pixel array 106 and the backlight module 108 to display images in accordance with the disclosed techniques.

As shown, in addition to the LCD 102, the 3D imaging apparatus 104 further includes a pair of 3D shutter glasses 112. The driver module 110 controls the pixel array 106 and the backlight module 108 to display left eye and right eye images. Further, the driver module 110 controls the pair of 3D shutter glasses 112 through the transmitter TX to enable the left eye and right eye spectacle lens alternately corresponding to the images displayed on the LCD 102, thereby providing a 3D visual experience to the viewer.

Figure 2A:
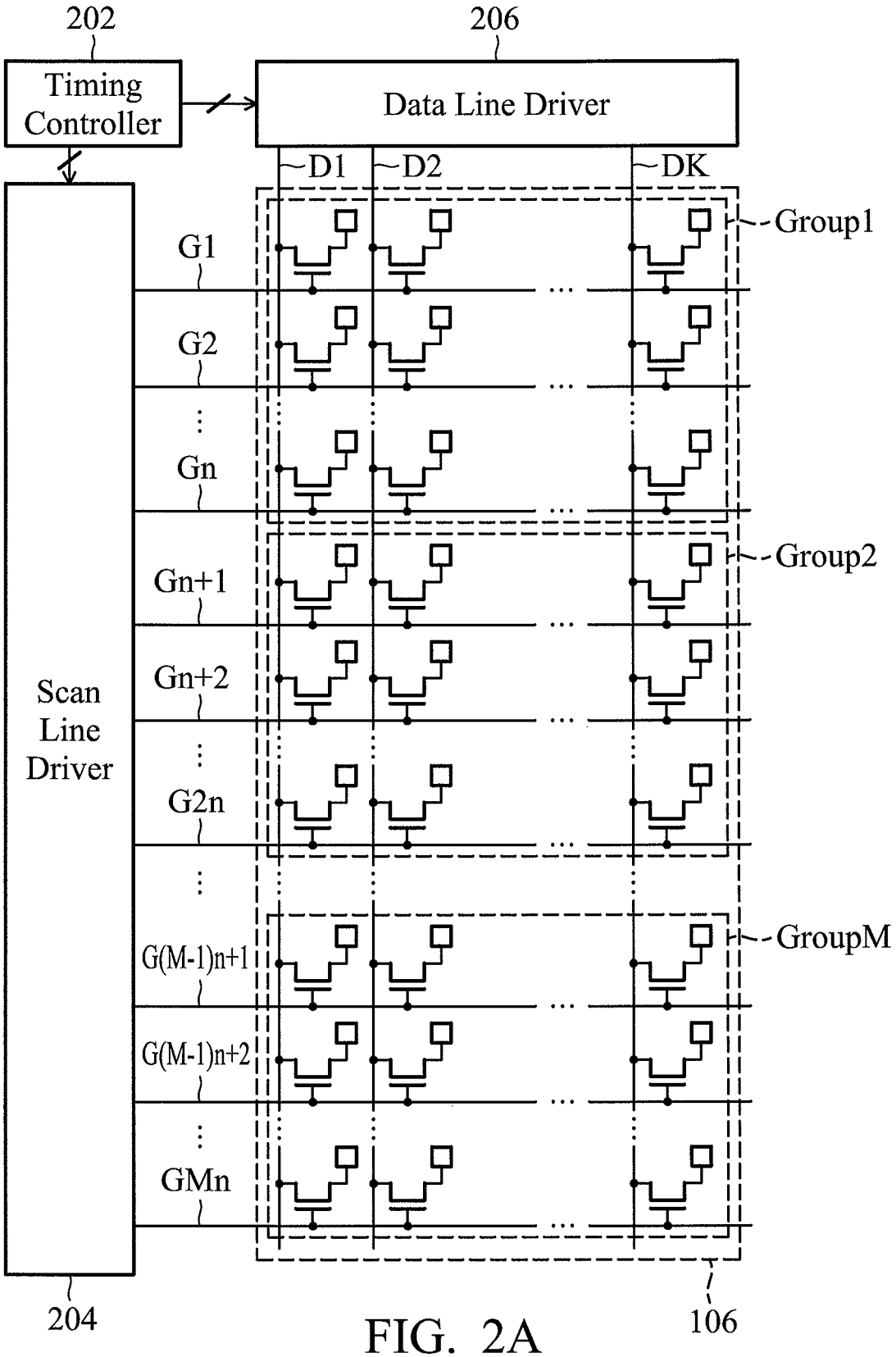
FIG. 2A depicts the structure of the pixel array 106 (not intended to limit thereto) and some function blocks (including a timing controller 202, a scan line driver 204 and a data line driver 206) of the driver module 110.

FIG. 2A depicts a structure of the pixel array 106 (just an exemplary embodiment, not intended to limit thereto) and some function blocks (including a timing controller 202, a scan line driver 204 and a data line driver 206) of the driver module 110. The timing controller 202 controls the operating timing of the scan line driver 204 and the data line driver 206. The scan line driver 204 enables the rows of pixels of the pixel array 106 via scan lines G1~GMn. The data line driver 206 provides data to the data lines D1, D2 . . . DK to be conveyed to the rows of pixels which are being enabled by the scan line driver 204. According to the disclosure, the timing controller 202, the scan line driver 204 or/and the data line driver 206 are adapted to operate the pixel array 106 such as the following discusses.

Referring to FIG. 2A, the rows of the pixel array 106 are divided into M groups. The rows controlled by the scan lines G1, G2 . . . Gn belong to the same group Group1. The rows controlled by the scan lines Gn+1, Gn+2 . . . G2n belong to the same group Group2. The rest of the rows are grouped similarly. The last group GroupM includes the rows controlled by scan lines G(M−1)n+1, G(M−1)n+2 . . . GMn.

To display a frame of data, the pixel array 106 is scanned twice, by a first frame scan and a second frame scan. In the first frame scan, the scan lines of the pixel array 106 are driven in groups (e.g., Group1, Group2 . . . GroupM are driven in turn.) The rows scanned by the scan lines of the same group are driven by identical data. For example, the rows scanned by the scan lines of Group1 are all driven by the row of data for the row of pixels controlled by the scan line G1. The rows scanned by the scan lines of Group2 are all driven by the row of data for the row of pixels controlled by the scan line Gn+1. Similarly, the rows scanned by the scan lines of GroupM are all driven by the row of data for the row of pixels controlled by the scan line G(M−1)n+1. In the second frame scan, the rows not driven by correct data in the first frame scan (i.e., including the rows scanned by the scan lines G2 . . . Gn belonging to Group1, the rows scanned by the scan lines Gn+2 . . . G2n belonging to Group2, . . . , and the rows scanned by the scan lines G(M−1)n+2 . . . GMn belonging to GroupM) are corrected to display the planned image.

Figure 2B:
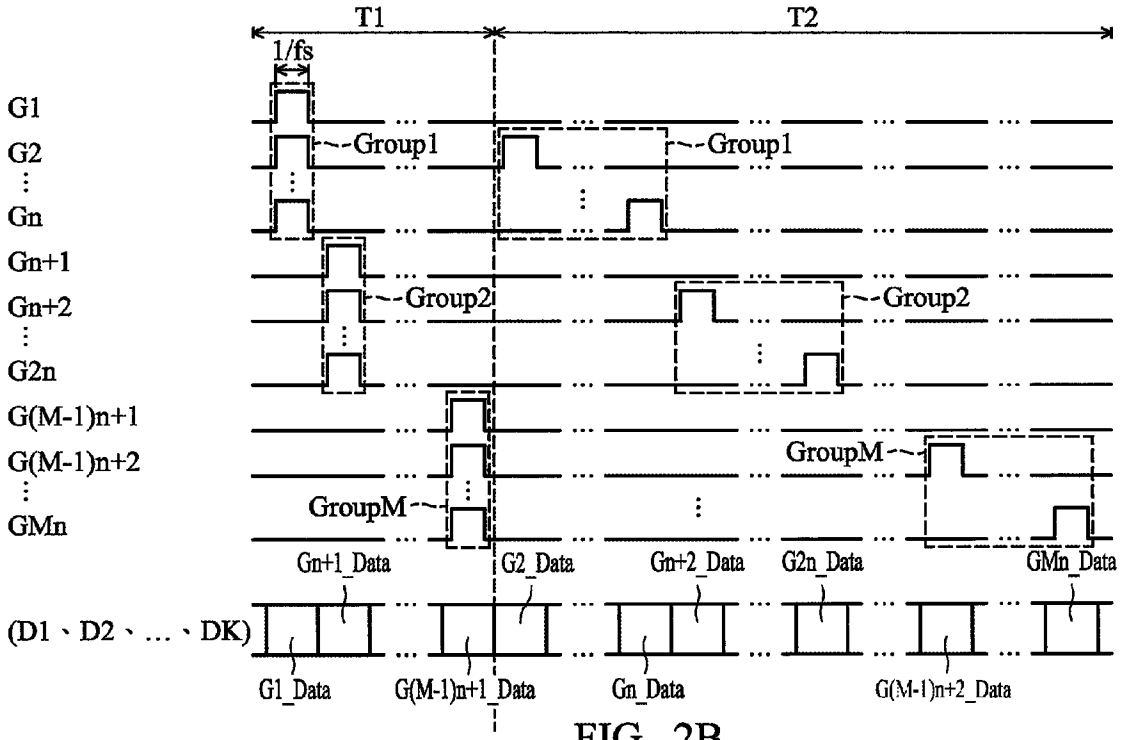
FIG. 2B shows waveforms of signals on the scan lines and the data lines, for discussion about the first frame scan and the second frame scan.

FIG. 2B shows waveforms of signals on the scan lines and the data lines when a first frame scan and a second frame scan are performed to display a frame of data. During the time period T1, the first frame scan is performed. First, the scan lines G1, G2 . . . Gn of Group1 are enabled together. Then, it is switched to enable the scan lines Gn+1, Gn+2 . . . G2n of Group2. Similarly, the scan lines of the remaining groups are enabled group by group and, finally, the scan lines G(M−1)n+1, G(M−1)n+2 . . . GM of GroupM are enabled together. Because the scan lines are enabled group by group, the rows of data transferred by the data lines D1, D2 . . . Dk in different time points are in the following order corresponding to the different groups: a row of data G1_Data, a row of data Gn+1_Data . . . a row of data G(M−1)n+1. The row of data G1 Data is selected from the frame of data assigned to be displayed, and is corresponding to the row scanned by the scan line G1. The row of data Gn+1_Data is selected from the frame of data assigned to be displayed, and is corresponding to the row scanned by the scan line Gn+1. The row. of data G(M−1)n+1_Data is selected from the frame of data assigned to be displayed, and is corresponding to the row scanned by the scan line G(M−1)n+1. During the time period T2, the second frame scan is performed. The rows of the pixels not driven by correct data in the first frame scan are enabled in succession to be corrected. First, the scan lines G2 . . . Gn of Group1 are enabled alternately. Then, the scan lines Gn+2 . . . G2n are enabled alternately. The erroneously driven rows of the remaining groups are enabled in a similar manner in succession. Finally, the scan lines G(M−1)n+2 . . . GM of GroupM are enabled one by one. Based on the enable sequence of the scan lines, the rows of data transferred via the data lines D1, D2 . . . DK in different time points are in the following order: G2_Data . . . Gn_Data, Gn+2_Data . . . G2n_Data, and similarly G(M−1)n+2_Data . . . GMn_Data. The rows of data G2_Data to_Gn_Data are selected from the frame of data assigned to be displayed, and are corresponding to the rows scanned by the scan line G2 to Gn. The rows of data Gn+2_Data to_G2n_Data are selected from the frame of data assigned to be displayed, and are corresponding to the rows scanned by the scan line Gn+2 to G2n. The rows of data G(M−1)n+2_Data to_GMn_Data are selected from the frame of data assigned to be displayed, and are corresponding to the rows scanned by the scan line G(M−1)n to GMn.

Further, the backlight module 108 is controlled in accordance with the first frame scan. Conventionally, the scan lines are separately scanned and at least $$M \cdot n \cdot \frac{1}{fs}$$

seconds are required to scan an entire frame. However, as shown in FIG. 1, only 1/n fraction of time $$\left(\text{i.e. } M \cdot \frac{1}{fs} \text{ seconds}\right)$$

is consumed in the first frame scan in comparison with the conventional technique. In this manner, it is not necessary for the backlight module 108 to take a long time to wait for the end of a row-by-row scan. The backlight module 108 is turned on more quickly in comparison with conventional techniques, and the waiting time may be reduced to 1/n. Thus, there is no need to sacrifice the scan time (1/fs) of each scan line. The scan time is long enough to rotate the liquid crystal materials. In an exemplary embodiment, the backlight module 108 starts the illumination on different areas of the pixel array at different times. In an exemplary embodiment, backlight segments (each is operative to illuminate a particular area) are controlled separately, wherein the different reaction intervals of the liquid crystal materials of the different groups Group1 . . . GroupM caused by the image correction performed in the second frame scan are taken into account. In this manner, the backlight module 108 illuminates the correctly rotated LC materials at the correct points in time. Thus, left eye and right eye images are correctly displayed on the LCD 102. With properly controlled glasses 112, the viewer perceives 3D images.

Note that the representative row of a group for prewriting the same data to the other rows of the group in the first frame scan is not limited to the first row of the group. The representative row of each group may be selected by the user. Further, the representative rows selected for displaying a first frame of data may be different from the representative rows selected for displaying a second frame of data. In an exemplary embodiment, each group contains two scan lines on the pixel array 106 and the two scan lines of the same group are adjacent to each other. When driving the pixel array 106 to display a first frame of data, the driver module 110 may regard the even rows of the pixel array 106 as the representative rows for the first frame scan. When driving the pixel array 106 to display a second frame of data, the driver module 110 may regard the odd rows of the pixel array 106 as the representative rows for the first frame scan.

Further, note that the amount of scan lines of each group may be any number.

After the first frame scan, the backlight module may illuminate different areas of the pixel array in accordance with the data corrections performed in the second frame scan for the different groups, and thereby the reactions of the liquid crystal materials of the different groups are taken into account in the backlight illumination. The correctly displayed left eye and right eye images are perceived by a viewer wearing properly controlled 3D shutter glasses. The viewer is provided with a 3D visual experience. In an exemplary embodiment, different areas of a pixel array are illuminated and shown in front of the viewer in the second frame scan.

Figure 3:
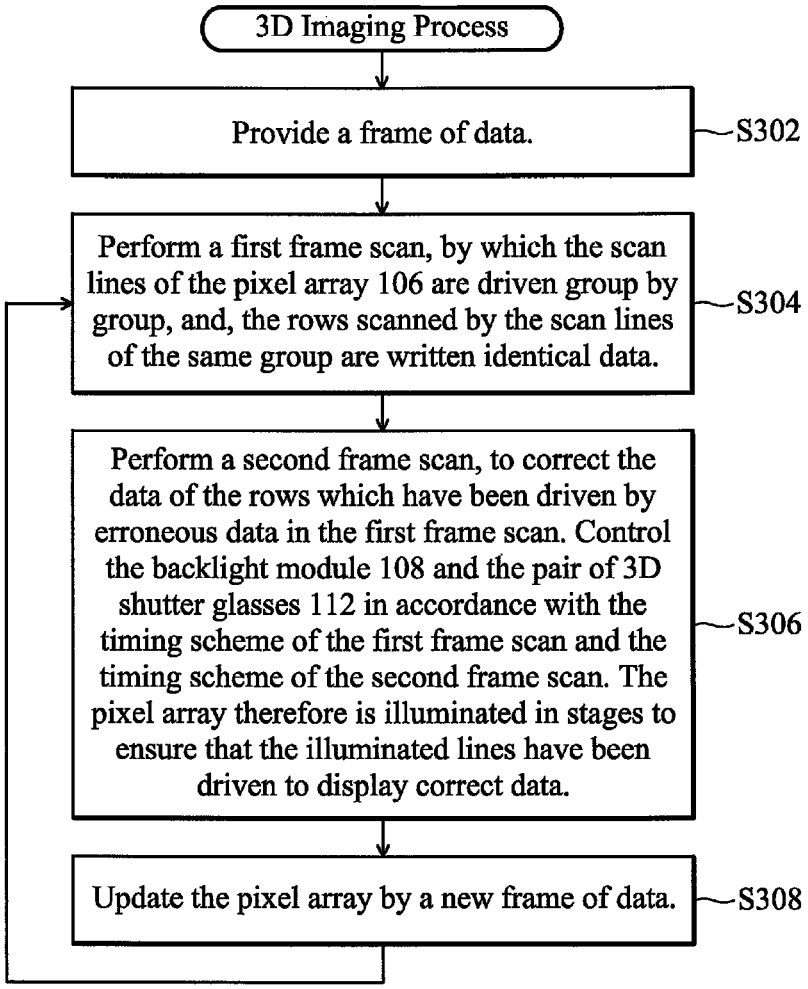
FIG. 3 is a flowchart depicting a 3D imaging process in accordance with an exemplary embodiment of the invention.

To form 3D images, the operating method of FIG. 2B is repeatedly performed to operate the structure of FIG. 2A for displaying left eye and right eye images, alternately. FIG. 3 is a flowchart depicting a 3D imaging process in accordance with an exemplary embodiment of the invention. In step S302, a frame of data is provided (not limit to a left eye frame data or a right eye frame data). For displaying the frame of data, a first frame scan is performed in step S304. In step S304, the scan lines of the pixel array 106 are driven group by group, and, the rows scanned by the scan lines of the same group are written identical data. In step S306, a second frame scan is performed to correct the data of the rows which have been driven by erroneous data in the first frame scan. Further, in step S306, the backlight module 108 and the pair of 3D shutter glasses 112 are controlled in accordance with the timing scheme of the first frame scan and the timing scheme of the second frame scan. The pixel array therefore is illuminated in stages to ensure that the illuminated lines have been driven to display correct data. In step S308, a new frame of data is provided to update the pixel array. For example, a right eye frame data is provided to replace a left eye frame data currently displayed on the LCD, or, a left eye frame data is provided to replace a right eye frame data currently displayed on the LCD. To display the new frame of data, the steps S304 and S306 are repeated again. In this manner, correct images displayed on the LCD are perceived by the viewer's left eye and right eye alternately for a 3D visual experience.

According to the disclosed techniques, the liquid crystal materials are provided with sufficient time for efficient rotation and the switching of the backlight module, by which the 3D visual experience of the viewer is improved.

Figure 4:
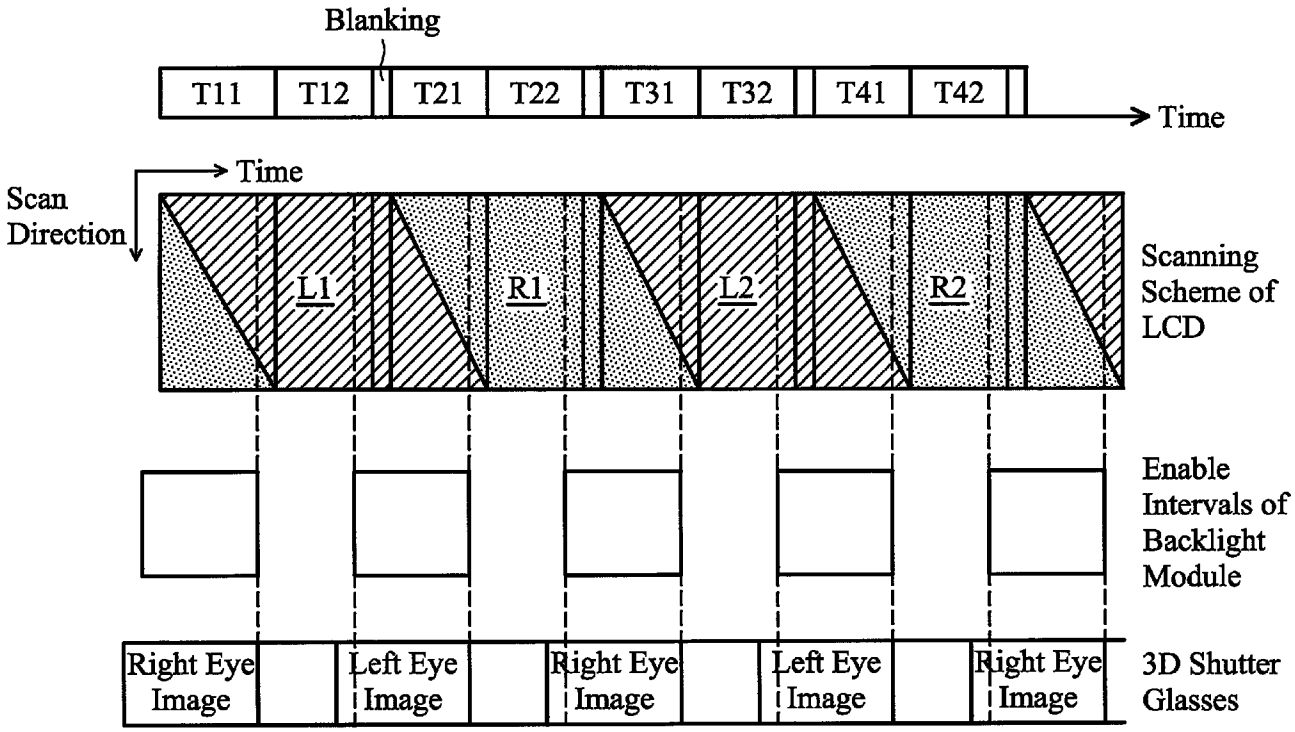
FIG. 4 depicts a 3D imaging technology in accordance with an exemplary embodiment of the invention, wherein every two lines of a pixel array are regarded as one group and the two lines of the same group are adjacent to each other in the pixel array 106.

FIG. 4 depicts a control scheme based on an exemplary embodiment of the 3D imaging method of the disclosure. In this embodiment, each group includes two scan lines of the pixel array 106, which are adjacent to each other. As shown in FIG. 4, a frame of data L1 for the left eye of the viewer is displayed on an LCD by a first frame scan T11 and a second frame scan T12. A frame of data R1 for the right eye of the viewer is displayed on the LCD by a first frame scan T21 and a second frame scan T22. A frame of data L2 for the left eye of the viewer is displayed on the LCD by a first frame scan T31 and a second frame scan T32. A frame of data R2 for the right eye of the viewer is displayed on the LCD by a first frame scan T41 and a second frame scan T42. The first frame scan and the second frame scan for displaying each frame of data may be performed in accordance with the techniques of FIGS. 2A and 2B. FIG. 4 also depicts the operation schemes of the backlight module 108 and the pair of 3D shutter glasses 112. The backlight module 108 and the pair of 3D shutter glasses 112 are operated in accordance with the first scan (T11, T21, T31, T41) or even the second frame scan (T12, T22, T32, T42).

In an exemplary embodiment, the even rows of the pixel array 106 are regarded as representative rows for the first frame scan (T11, T21, T31, T41). In the first frame scan (T11, T21, T31, T41), the odd rows of the pixel array 106 are driven by the same data as the even rows corresponding thereto. In the second frame scan (T12, T22, T32, T42), the pixels of the odd rows are driven again and corrected.

In an exemplary embodiment, the odd rows of the pixel array 106 are regarded as representative rows for the first frame scan (T11, T21, T31, T41). In the first frame scan (T11, T21, T31, T41), the even rows of the pixel array 106 are driven by the same data as the odd rows corresponding thereto. In the second frame scan (T12, T22, T32, T42), the pixels of the even rows are driven again and corrected.

In an exemplary embodiment, the successive two frames of data for a specific eye of the viewer may use totally different representative rows (e.g., even rows are regarded as representative rows for displaying a first frame of data and odd rows are regarded as representative rows for displaying a second frame of data). Referring to FIG. 4, L1 and L2, the two successive frames of data for the left eye of the viewer are shown. For displaying L1, even rows are regarded as the representative rows for the first frame scan T11. In the first frame scan T11, the odd rows are driven by the same data as the even rows corresponding thereto. In the second frame scan T12, the odd rows are driven again and corrected. For displaying L2, odd rows are regarded as the representative rows for the first frame scan T31. In the first frame scan T31, the even rows are driven by the same data as the odd rows corresponding thereto. In the second frame scan T32, the even rows are driven again and corrected. Corresponding to the display method of L1 and L2, the successive two frames of data R1 and R2 for the right eye of the viewer should be displayed by the following method. For displaying R1, even rows are regarded as the representative rows for the first frame scan T21. In the first frame scan T21, the odd rows are driven by the same data as the even rows corresponding thereto. In the second frame scan T22, the odd rows are driven again and corrected. For displaying R2, odd rows are regarded as the representative rows for the first frame scan T41. In the first frame scan T41, the even rows are driven by the same data as the odd rows corresponding thereto. In the second frame scan T42, the pixels of the even rows are driven again and corrected.

Further, a blank scanning technique may be required when displaying the images. In FIG. 4, the first frame scan and the second frame scan (e.g. T11 and T12) occur consecutively. A blank scan follows the second frame scan.

Figure 5:
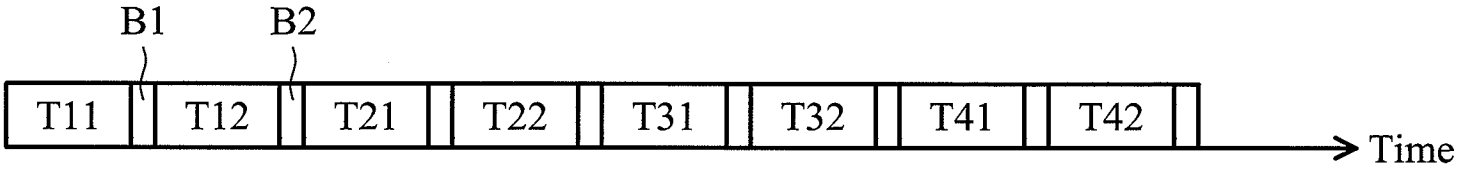
FIG. 5 depicts a blank scanning technology in accordance with an exemplary embodiment of the invention.

FIG. 5 depicts another exemplary embodiment of the disclosure. A first blank scan B1 is inserted between the first frame scan T11 and the second frame scan T12, and a second black scan B2 follows the second frame scan T12.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A liquid crystal display, comprising:

a pixel array including a plurality of pixels, the pixels arranged at intersections of a plurality of scan lines and a plurality of data lines;

a backlight module; and a driver module, driving the pixel array to display a frame of data by a first frame scan and a second frame scan, and controlling the backlight module in accordance with the first frame scan and the second frame scan, wherein:

the driver module performs the first frame scan to drive the scan lines of the pixel array group by group wherein, in each group, rows of the pixels are written identical row data by the first frame scan;

the driver module performs the second frame scan after the first frame scan, to correct the data of the pixels in the second frame scan;

the backlight module illuminates the pixel array and illumination on different areas of the pixel array are controlled separately, wherein the rows of the pixels which have been scanned in the second frame scan are qualified to be illuminated by the backlight module; and the driver module performs a first blank scan after the first frame scan and prior to the second frame scan, and performs a second blank scan consecutively after the second frame scan.

2. The liquid crystal display as claimed in claim 1, wherein:

at least every two scan lines of the pixel array are regarded as one group, and the scan lines of the same group are adjacent to each other; and the driver module regards the even rows of the pixel array as representative rows for a first frame of data, so that the odd rows of the pixel array are driven in accordance with the even rows when the first frame scan corresponding to the first frame of data is performed; and the driver module regards the odd rows of the pixel array as representative rows for a second frame of data, so that the even rows of the pixel array are driven in accordance with the odd rows when the first frame scan corresponding to the second frame of data is performed.

3. The liquid crystal display as claimed in claim 1, wherein the driver module performs the second frame scan consecutively after the first frame scan.

4. A 3D imaging apparatus, comprising:

the liquid crystal display as claimed in claim 1, and a pair of 3D shutter glasses, wherein the driver module of the liquid crystal display operates the pair of 3D shutter glasses in accordance with the first frame scan.

5. The 3D imaging apparatus as claimed in claim 4, wherein:

at least every two scan lines of the pixel array are regarded as one group, and the scan lines of the same group are adjacent to each other; and when the driver module drives the pixel array to display a first frame of data for a specific eye of a viewer, even rows of the pixel array are regarded as representative rows for the first frame of data, so that, in the first frame scan corresponding to the first frame of data, odd rows of the pixel array are driven in accordance with the even rows; and when the driver module drives the pixel array to display a second frame of data for the specific eye of the viewer, the odd rows of the pixel array are regarded as representative rows for the second frame of data, so that, in the first frame scan corresponding to the second frame of data, the even rows of the pixel array are driven in accordance with the odd rows.

6. A liquid crystal display, comprising:

a pixel array including a plurality of pixels, the pixels arranged at intersections of a plurality of scan lines and a plurality of data lines;

a backlight module; and a driver module, driving the pixel array to display a frame of data by a first frame scan and a second frame scan, and controlling the backlight module in accordance with the first frame scan and the second frame scan, wherein the driver module performs the first frame scan to drive the scan lines of the pixel array group by group wherein, in each group, rows of the pixels are written identical row data by the first frame scan, wherein the driver module performs the second frame scan after the first frame scan, to correct the data of the pixels in the second frame scan, wherein each group of the scan lines includes at least three scan lines, and wherein the driver module performs a first blank scan after the first frame scan and prior to the second frame scan, and performs a second blank scan consecutively after the second frame scan.

7. The liquid crystal display as claimed in claim 6, wherein the backlight module illuminates the pixel array and illumination on different areas of the pixel array are controlled separately, wherein the rows of the pixels which have been scanned in the second frame scan are qualified to be illuminated by the backlight module.

8. The liquid crystal display as claimed in claim 6, wherein the driver module performs the second frame scan consecutively after the first frame scan.

9. An operating method for a liquid crystal display, comprising:

performing a first frame scan and a second frame scan to drive a pixel array of the liquid crystal display to display a frame of data, the pixel array including a plurality of pixels arranged at intersections of the scan lines and the data lines; and controlling a backlight module of the liquid crystal display in accordance with the first frame scan and the second frame scan, wherein at least every three scan lines of the pixel array are regarded as one group, and the scan lines of the pixel array are driven in the first frame scan group by group, and, in the first frame scan, the rows scanned by the scan lines of the same group are driven by identical data, wherein the data of the pixels are corrected in the second frame scan, and wherein a first blank scan is performed after the first frame scan and prior to the second frame scan, and a second blank scan is performed consecutively after the second frame scan.

10. The operating method as claimed in claim 9, wherein in the first frame scan, all rows scanned by the scan lines of the same group are driven by the data arranged to be displayed by a representative row of the same group.

11. The operating method as claimed in claim 9, wherein the second frame scan is performed consecutively after the first frame scan.

12. The operating method as claimed in claim 9, utilized in operating a liquid crystal display of a 3D imaging apparatus.

13. The operating method as claimed in claim 12, further controlling a pair of 3D shutter glasses of the 3D imaging apparatus in accordance with the first frame scan of the liquid crystal display.

* * * * *